US005887278A

United States Patent [19]

Lewis et al.

[11] Patent Number: 5,887,278

[45] Date of Patent: Mar. 30, 1999

[54] DISPOSABLE BIB HAVING NOTCHED TEAR RESISTANCE

[75] Inventors: Robert Drennan Lewis, Hamilton; Julie Ann Pawlikowski, Cincinnati; Beverly Ann Julian Jackson, Hamilton; Richard Nicholas Reinhart, Cincinnati, all of Ohio

[73] Assignee: The Procter & Gamble Company, Cincinnati, Ohio

[21] Appl. No.: 792,332

[22] Filed: Jan. 31, 1997

[51] Int. Cl.[6] ..... A41C 13/10; A41D 27/00

[52] U.S. Cl. ..... 2/49.1; 2/243.1

[58] Field of Search ..... 2/46, 49.1, 49.2, 2/49.3, 49.4, 49.5, 50, 75, 51, 80, 52, 83, 174, 243.1, 455, 456, 457, 463, 901, 7, 1, 464, 104, 105, 106, 113, 114, 115, 118, 119

[56] References Cited

U.S. PATENT DOCUMENTS

| | | | |
|---|---|---|---|
| 2,838,758 | 6/1958 | Townley | 2/49 |
| 3,286,279 | 11/1966 | Brown | 2/19 |
| 3,329,969 | 7/1967 | Farber et al. | 2/49 |
| 3,332,547 | 7/1967 | Rowe et al. | 206/56 |
| 3,414,459 | 12/1968 | Wells | 161/131 |
| 3,532,800 | 10/1970 | Wyly et al. | 174/25 |
| 3,608,092 | 9/1971 | Taranto | 2/49 R |
| 3,837,995 | 9/1974 | Floden | 161/150 |
| 3,862,877 | 1/1975 | Camden | 161/57 |
| 3,871,027 | 3/1975 | Orr | 2/49 R |
| 3,916,447 | 11/1975 | Thompson | 2/46 |
| 3,945,048 | 3/1976 | Shearer | 2/49 R |
| 3,979,776 | 9/1976 | Gruenwald | 2/49 R |
| 3,995,321 | 12/1976 | Johnson | 2/49 R |
| 3,999,221 | 12/1976 | Hannigan | 2/49 R |
| 4,136,222 | 1/1979 | Jonnes | 2/243.1 |
| 4,186,443 | 2/1980 | Britzman | 2/49 R |
| 4,233,688 | 11/1980 | Hjerl | 2/49 R |
| 4,261,057 | 4/1981 | Andersson | 2/49 R |
| 4,269,322 | 5/1981 | Larson | 220/94 R |
| 4,416,025 | 11/1983 | Moret et al. | 2/49 R |
| 4,441,212 | 4/1984 | Ahr et al. | 2/49 R |
| 4,445,231 | 5/1984 | Noel | 2/49 R |
| 4,495,658 | 1/1985 | Moret et al. | 2/49 R |
| 4,522,863 | 6/1985 | Keck et al. | 428/96 |
| 4,523,333 | 6/1985 | Spangler | 2/49 R |
| 4,523,334 | 6/1985 | Lavash | 2/49 R |
| 4,569,086 | 2/1986 | Takefman | 2/49 R |
| 4,582,735 | 4/1986 | Smith | 428/36 |
| 4,641,159 | 2/1987 | Seitz et al. | 346/200 |
| 4,646,365 | 3/1987 | Surprise et al. | 2/49 R |

(List continued on next page.)

FOREIGN PATENT DOCUMENTS

| | | | |
|---|---|---|---|
| 2 148 700 A | 6/1985 | European Pat. Off. | A41B 13/10 |
| 0 497 608 A1 | 1/1992 | European Pat. Off. | B32B 27/06 |
| 0 672 402 A1 | 2/1995 | European Pat. Off. | A61F 13/15 |
| 2698314 A1 | 11/1992 | France | B31F 5/00 |
| 41 31 300 A1 | 9/1991 | Germany | A41D 13/10 |
| 1217892 | 12/1970 | United Kingdom . | |
| 2190111 | 11/1989 | United Kingdom | D04H 1/42 |
| 2 232 340 A | 12/1990 | United Kingdom | A41B 13/10 |
| WO 96/20613 | 7/1996 | WIPO | A41B 13/10 |
| WO 97/28707 | 8/1997 | WIPO | A41B 13/10 |

OTHER PUBLICATIONS

Procter & Gamble Company Test Request/Preparation Report data.

Article on "Nets" (p. 237) fron Essentials of texitles, Third Edition by Marjory L. Joseph.

Article on "A Model for Designing Out the Potential Choking Risk to Infants of a Disposable Bib" by Van Rafelghem.

*Primary Examiner*—Jeanette Chapman

*Attorney, Agent, or Firm*—Jay A. Krebs; Larry L. Huston; Gerry S. Gressel

[57] ABSTRACT

The present invention provides a bib having a relatively high Notched Tear Resistance in combination with a relatively low Circular Bending Stiffness. The relatively high Notched Tear Resistance reduces the ability of an infant wearer to tear off a piece of the bib when a bib has been punctured (e.g. by biting). The relatively low Circular Bending Stiffness provides a soft, drapable bib which is comfortable to the wearer.

20 Claims, 7 Drawing Sheets

U.S. PATENT DOCUMENTS

| | | | |
|---|---|---|---|
| 4,649,572 | 3/1987 | Roessler | 2/49 R |
| 4,660,226 | 4/1987 | Quilling et al. | 2/49 R |
| 4,733,411 | 3/1988 | Foti | 2/49 |
| 4,769,024 | 9/1988 | Pile et al. | 604/390 |
| 4,779,288 | 10/1988 | Mack | 2/49 R |
| 4,787,099 | 11/1988 | Mack | 2/49 R |
| 4,793,004 | 12/1988 | Long et al. | 2/49 R |
| 4,797,952 | 1/1989 | Petrini | 2/49 R |
| 4,846,822 | 7/1989 | Foxman | 604/370 |
| 4,884,299 | 12/1989 | Rose | 2/49 R |
| 4,891,846 | 1/1990 | Sager et al. | 2/49 R |
| 4,915,993 | 4/1990 | Ten Wolde | 428/40.1 |
| 4,950,264 | 8/1990 | Osborrn, III | 604/385.1 |
| 5,009,653 | 4/1991 | Osborn, III | 604/385.1 |
| 5,074,013 | 12/1991 | Arnold et al. | 24/713 |
| 5,098,764 | 3/1992 | Drelich et al. | 428/255 |
| 5,407,612 | 4/1995 | Gould et al. | 264/24 |
| 5,477,560 | 12/1995 | Shope | 2/49.1 |
| 5,490,289 | 2/1996 | Lehrer | 2/49.2 |

DISPOSABLE BIB HAVING NOTCHED TEAR RESISTANCE

This patent application claims priority to and incorporates by reference the following copending, commonly assigned patent applications: U.S. Ser. No. 08/599,208, "Disposable Bib Having Filamentary Reinforcing Layer" filed Feb. 9, 1996 in the name of Reinhart; U.S. Ser. No. 08/513,643, "Bib Having an Improved Neck Opening" filed Aug. 10, 1995 in the name of Reinhart; U.S. Ser. No. 08/513,496, "Bib Having an Improved Pocket" filed Aug. 10, 1995 in the name of Reinhart.

FIELD OF THE INVENTION

The present invention is related to disposable bibs, and more particularly, to a disposable bib which resists tearing while maintaining a relatively high degree of flexibility.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper layer for receiving spilled food material and a plastic film layer for preventing penetration of spilled liquids through the bib and onto the baby's clothing. Other multiple layer bib constructions are also known.

Disposable bibs can have the disadvantage that an infant wearer can puncture the bib, such as by biting. If the infant wearer then tears off a piece of the bib, the effective coverage of the wearer's clothes is decreased. Additionally, separate torn pieces of the bib create additional pieces of waste requiring disposal.

Adding a woven element to a bib, such as a woven cloth layer to provide absorbency or strength, has the disadvantage that such woven constructions increase the cost of the bib. The costs of woven structures make such structures impractical for use in disposable bibs.

Attempting to reduce tearing of the bib by merely increasing the tensile strength of one or more components of the bib is also generally not satisfactory. For instance, increasing the tensile strength of the bib, such as by merely changing the thickness of one of the bib components, generally results in an undesirable increase in stiffness. Further, increasing the tensile strength can result in higher material costs or added complexity of manufacture.

More importantly, the Applicants have found that merely increasing the tensile strength of the bib does not necessarily reduce the in use incidence of tearing of the bib. Applicants have discovered that incidence of tearing of the bib is correlated with a property hereinafter referred to as the Notched Tear Resistance (NTR) of the bib. The Notched Tear Resistance is a determination of the force required to tear a previously notched sample of a substrate into two separate pieces.

Additionally, the Applicants have invented a disposable bib having an NTR which substantially reduces the incidence of tearing of the bib without substantially increasing the stiffness of the bib. The inventive bib also provides the reduced incidence of tearing without requiring an excessively high bib peak tensile strength.

Accordingly, it is an object of the present invention to provide a disposable bib which resists tearing.

Another object of the present invention is to provide a disposable bib which resists tearing yet is relatively flexible.

Another object of the present invention is to provide a disposable bib which resists tearing yet has a peak tensile strength below a threshold value.

Yet another object of the present invention is to provide a disposable bib without the use of woven elements, wherein the bib resists tearing and is relatively flexible.

SUMMARY OF THE INVENTION

The present invention provides a tear resistant disposable bib having a Notched Tear Resistance (NTR) of at least about 410 grams, more preferably at least about 485 grams, and most preferably at least about 500 grams. The NTR is measured using the procedure set forth below.

The bib of the present invention preferably also has a Circular Bending Stiffness (CBS) of less than about 60 grams, more preferably less than about 50 grams, and even more preferably less than about 40 grams. The CBS is measured using a procedure which is also set forth below.

The bib also preferably has a peak tensile strength of less than about 8000 grams/inch, more preferably less than about 6000 grams/inch, and still more preferably less than about 5000 grams/inch, as measured using the procedure set forth below. Accordingly, the present invention provides a tear resistant bib which substantially reduces the incidence of in use tearing, without sacrificing flexibility, and without requiring a high bib tensile strength.

The disposable bib of the present invention provides desired levels of tear resistance and flexibility without the use of woven elements. Preferably, the disposable bib of the present invention comprises one or more layers wherein each layer is selected from the group consisting of paper webs (including wet laid and air laid paper webs), non-wovens, liquid impermeable films, liquid impermeable coatings, and combinations thereof.

The disposable bib of the present invention is preferably liquid impermeable, and can comprise a laminate of an outwardly facing, absorbent topsheet and a body facing, liquid impermeable backsheet. The absorbent topsheet can comprise paper webs, non-woven webs, and combinations thereof. In one embodiment, the absorbent topsheet can comprise an outwardly facing paper ply and an inner paper ply joined to the backsheet.

The bib can have a basis weight of no more than about 15, and preferably no more than about 12 milligrams per square centimeter. The bib can have a caliper of between about 15 and about 40 mils (0.015–0.040 inch).

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

FIGS. 1–4 illustrate a disposable bib 20 according to one embodiment of the present invention. The term "disposable bib" refers to a bib which is intended to be used once and then discarded, in contrast to durable, multi-use bibs, such as durable bibs comprising a woven construction. Disposable bibs can have a basis weight (weight per unit area) of less than about 15 milligrams per square centimeter and a caliper of no more than about 40 mils (0.040 inch).

The disposable bibs of the present invention are also preferably liquid impermeable. By "liquid impermeable" or "liquid impervious" it is meant that liquids spilled or dropped on the bib do not penetrate through the bib to the wearer or the wearer's garments during use of the bib.

Disposable bibs of the present invention can have a multiple layer construction, wherein each layer is selected from the group consisting of paper webs (wet laid and air laid paper webs), non-wovens, thermoplastic films, resin coatings, and combinations thereof.

Disposable bibs preferably have at least one absorbent layer. The absorbent layer is preferably disposed to be outwardly facing on the bib to receive and absorb spittle, as well as spilled liquids. The absorbent layer is preferably selected from the group consisting of paper webs, non-wovens, and combinations thereof. Non-wovens can be made by a number of different processes, including but not limited to meltblown, spunbonded, and carded, the latter including thermally bonded, air-through bonded, powder bonded, latex bonded, solvent bonded, or spunlaced.

Figure 1:
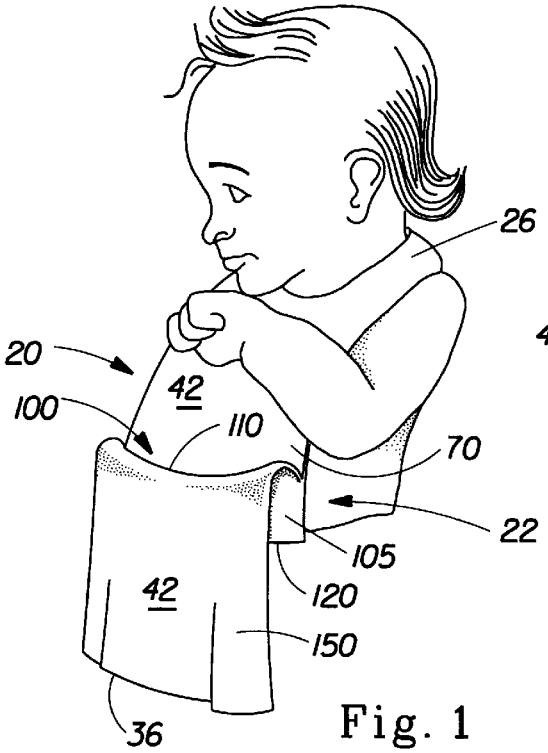
FIG. 1 is an in use perspective view of a disposable bib according to the present invention.

Referring to FIGS. 1–4, the bib 20 comprises a bib body 22 having longitudinally extending sides 32 and 34, a longitudinal length, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn as shown in FIG. 1. The terms "lateral" and "transverse" refer to a direction or axis which is perpendicular to the longitudinal centerline 21, and which is generally parallel to a line extending across the wearer's chest as the bib is worn.

Figure 4:
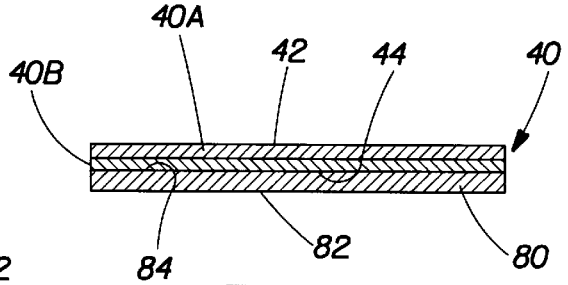
FIG. 4 is a schematic cross-sectional illustration of the laminate construction of the bib.
Figure 2:
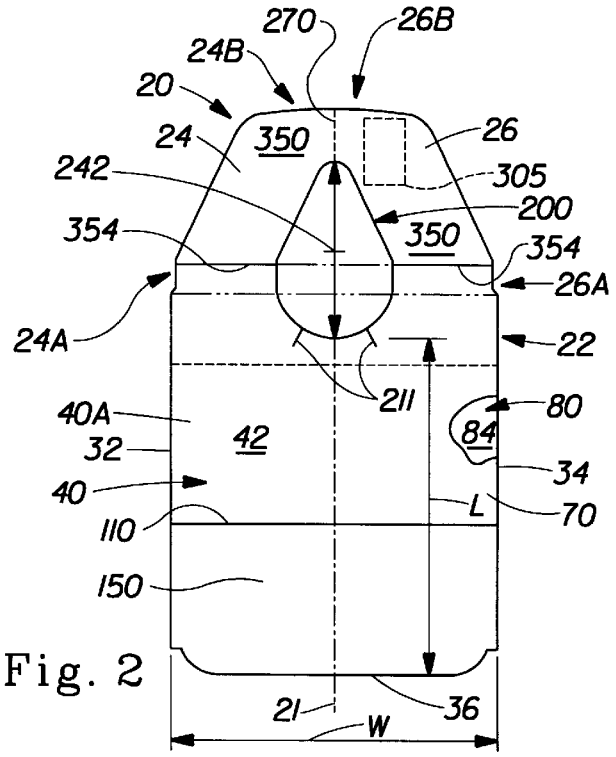
FIG. 2 is a schematic illustration of a front plan view of the disposable bib of the present invention wherein the bib is supported in a flat, generally planar orientation.
Figure 3:
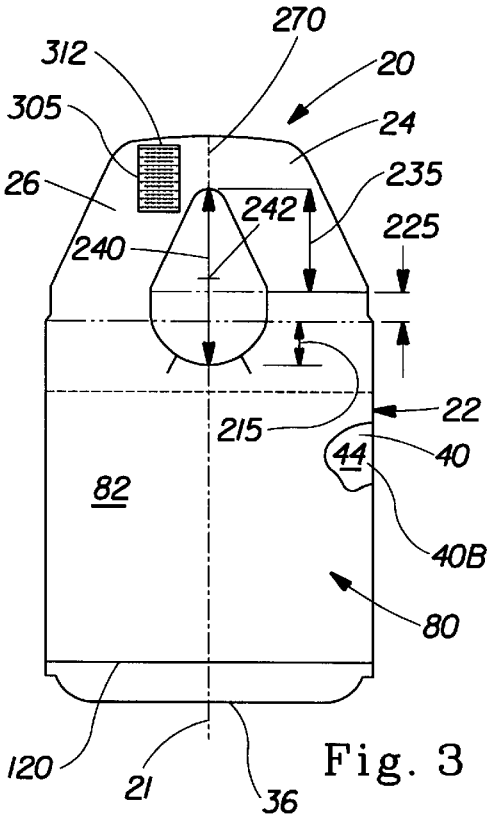
FIG. 3 is a schematic illustration of a rear plan view of the disposable bib of the present invention wherein the bib is supported in a flat, generally planar orientation.

The bib can comprise a laminate construction of at least two layers. Referring to FIGS. 2–4, the bib body 22 has a laminate construction including an absorbent topsheet 40 joined to a liquid impermeable backsheet 80. The topsheet 40 faces outwardly as the bib is worn, and the backsheet faces the body of the wearer as the bib is worn.

The topsheet 40 can comprise one or more plies of an absorbent paper web, an absorbent non-woven web, or combinations thereof. In the embodiment shown, the topsheet 40 includes an outer wet laid paper ply 40A and an inner wet laid paper ply 40B joined to the ply 40A.

The following U.S. patents are incorporated by reference for the purpose of disclosing how to make tissue paper suitable for use in making each of the plies 40A and 40B: U.S. Pat. Nos. 4,440,597; 4,529,480; 4,637,859; 5,223,096; and 5,240,562. The plies 40A and 40B can be of the type sold commercially as Bounty Medley brand Paper Towels manufactured by The Procter and Gamble Company of Cincinnati, Ohio.

Alternatively, a suitable non-woven from which the topsheet 40 can be formed is a spunbonded polypropylene non-woven material having a basis weight of between about 15 and about 30 grams per square meter. One suitable non-woven is a spunbonded polypropylene non-woven web commercially available as CELESTRA from Fiberweb of Simpsonville, S.C.

Another suitable non-woven from which the topsheet 40 can be formed is a carded polypropylene non-woven material having a basis weight of about 22 grams per square meter manufactured by the Veratec Division of the International Paper Corporation of Walpole, Mass. under the designation P-11, Supplier Grade #9324369.

In yet another embodiment, the topsheet 40 can comprise a combination of a paper web with a non-woven web, such as one of the non-woven webs listed above.

The backsheet 80 can comprise a thermoplastic film or resin layer. Examples of thermoplastic films include but are not limited to polypropylene and polyethylene films. In one embodiment, the backsheet 80 is a film comprising a blend of linear low density polyethylene and low density polyethylene.

In FIG. 2, a portion of the paper layer 40 is shown cut away to reveal the plastic film layer 80. The outer surface 42 of the paper ply 40A faces the viewer in FIG. 2. The body facing surface 82 of the plastic film layer 80 faces the viewer in FIG. 3.

The bib 20 preferably also comprises a pair of shoulder extensions 24, 26. The shoulder extensions 24, 26 extend from the bib body 22 from their proximal ends 24A, 26A to their distal ends 24B, 26B to provide a generally planar neck opening 200 when the bib is supported on a flat, horizontal surface.

The generally planar neck opening 200 can have a shape which is generally symmetric about the longitudinal centerline 21 and asymmetric about a lateral axis passing through the midpoint 242 of the length 240 of the opening 200, as disclosed in U.S. patent application Ser. No. 08/513,643 filed Aug. 10, 1995 in the name of Reinhart et al., which application is incorporated herein by reference.

The bib 20 can also include a pocket 100 extending substantially the full lateral width of the bib 20 for catching and receiving food particles. Referring to FIG. 1, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body.

The body panel 70 is disposed adjacent the wearer's body when the bib is secured to the wearer. The pocket panel 105 can have a generally rectangular shape, and is disposed adjacent the body panel 70 to form a pocket space intermediate the body panel and the pocket panel. The pocket panel 105 extends longitudinally from a pocket bottom edge 120 to a pocket open edge 110, and the pocket panel 105 extends laterally intermediate the bib side edges 32 and 34. The bottom edge 120 and the open edge 110 can both be substantially perpendicular to the longitudinal centerline 21 and substantially parallel to an imaginary lateral axis.

The apron panel 150 can extend from the pocket open edge 110 to the bib bottom edge 36. The apron panel 150 can depend in a pendulous fashion from the pocket open edge 110 to provide gravitational opening of the pocket 100. The body panel 70, pocket panel 105, and apron panel 150 can be formed from a continuous sheet of material, the sheet of material comprising one or more laminae. U.S. Pat. No. 4,445,231 "Bib Having Gravitationally Openable Pocket" issued May 1, 1984 to Noel and U.S. patent application Ser. No. 08/513,496 filed Aug. 10, 1995 are incorporated herein by reference for the purpose of showing a bib construction for forming a bib having a pocket and an apron panel.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array 305 of projections 312 extending from a portion of the shoulder extension 26. The projections 312 can be in the shape of a prong or hook, and are engagable with a non-woven web 350 extending over at least a portion of the shoulder extensions 24 and 26. The edge of the web 350 is indicated by numeral 354 in FIG. 2. The non-woven web 350 can be adhesively joined to the topsheet 40 on the shoulder extensions 24 and 26.

Prior to the time the bib is to be used, the shoulder extensions 24 and 26 can be joined together, such as at their distal ends, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly. In one embodiment, the selective line of weakening 270 is aligned with the longitudinal centerline 21, and comprises a plurality of spaced apart perforations.

In the following discussion, the labels X1, X2, N1, Z1, and Z2 refer to disposable bib samples made according to embodiments of the present invention. The labels Z1 and Z2 refer to bib samples which are relatively stiffer than bib samples labeled X1, X2, and N1.

The labels T1, T2, T3, T4, T5, T6 refer to test samples which do not meet the tear resistance and stiffness requirements of the present invention, and which are compared to the bib samples X1 and X2 made according to the present invention. The labels C1, C2, C3, C4, and C5 refer to commercially available bib samples which are compared to the bib samples X1 and X2 made according to the present invention. The labels D1, D2, and D3 refer to durable, non-disposable commercially available bibs having at least one woven layer or component.

Figure 5:
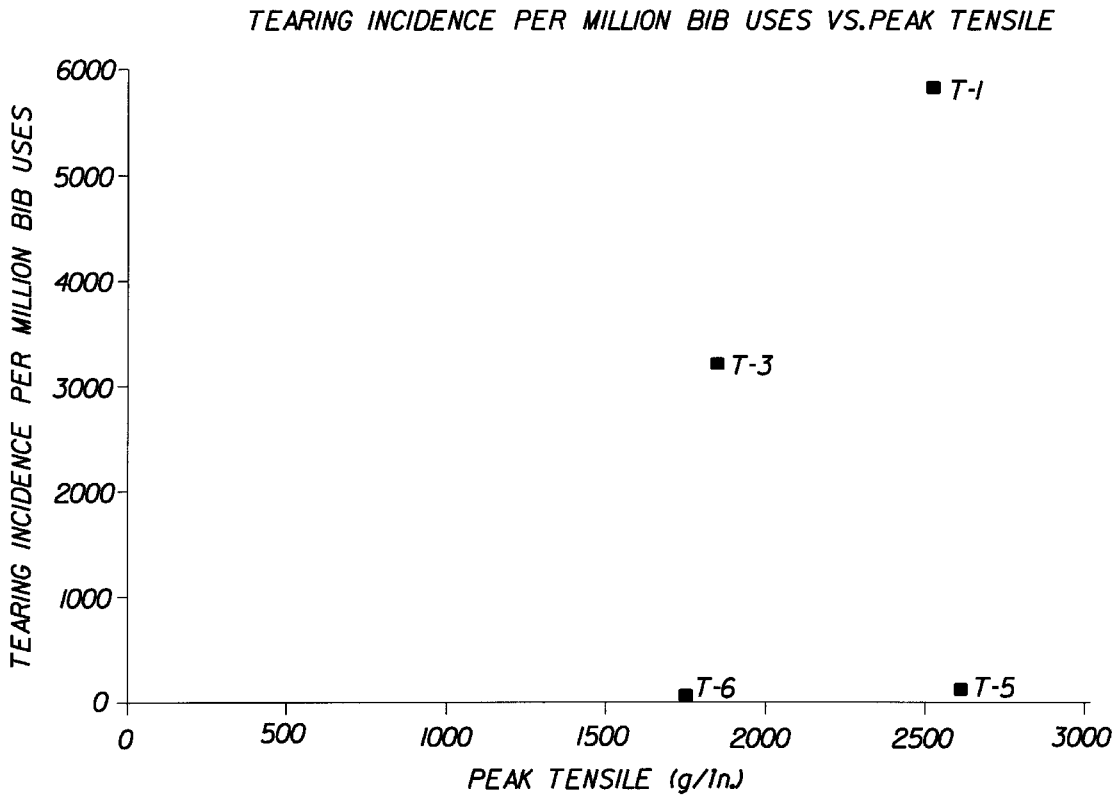
FIG. 5 is a graphical representation of bib tear incidence per million bib uses versus bib Peak Tensile Strength plotted for different bib samples, the graph illustrating lack of correlation between tear incidence and Peak Tensile Strength.

FIG. 5 illustrates the lack of correlation between actual in use incidence of tearing of bib samples and peak tensile strength, a conventional measure of strength. FIG. 6 illustrates the Applicants' discovery of correlation between in use incidence of tearing of bib samples and Notched Tear Resistance of the samples.

FIG. 5 is a graphical representation of in use tearing incidence of bib test samples T1, T3, T5, and T6. In FIG. 5, the number of in use incidents of tearing (piece separated from bib) for each test sample is plotted in units of incidents of tearing per million bib uses on the Y-axis. The Peak Tensile Strength of each test sample is plotted on the X axis. The procedure for measuring the Peak Tensile Strength is set forth below.

FIG. 5 illustrates that the tensile strength of a bib does not predict or correlate with the tear resistance of the bib. For instance, FIG. 5 shows that test sample T1 has a much higher Peak Tensile Strength than sample T6, yet T6 exhibited a much lower incidence of in use tearing than did T1. Accordingly, FIG. 5 illustrates that one cannot rely on the conventional wisdom that a higher tensile strength will result in a more tear resistant bib.

The in use tear incidence values in FIG. 5 were calculated from data collected from a base of in home test participants (generally parents) willing to use the test samples and record the number of uses of the test samples, as well as the number of incidence of tearing over a period of 3 days to 4 weeks. The test samples were worn by babies 5 to 36 months old. The participants completed a questionnaire regarding product performance, product acceptability, and number of bib uses and tearing incidents.

The actual number of tears and bib uses for all the bib samples tested (T1, T3, T5, T6) include: 4 tears per 684 uses for T1, 8 tears per 2460 uses for T3, 1 tear per 6,610 uses for T5, and 3 tears per 32000 uses for T6. The incidence of tearing per million uses for each of the four bib samples was calculated by extrapolating these data to predict the number of in use tears per million uses of the bib samples.

The data points for FIG. 5, including standard deviation (s.d.) for the Peak Tensile values plotted, are listed below in Table 1:

TABLE 1

Peak Tensile and Actual Tear Incidence per Million Bib Uses:

| Sample: | Peak Tensile (grams) | Tears per Million Uses |
|---|---|---|
| T1 | 2515 s.d. NA | 5848 |
| T3 | 1840 s.d. 174 | 3252 |
| T5 | 2602 s.d. 270 | 151 |
| T6 | 1750 s.d. 603 | 94 |

Figure 6A:
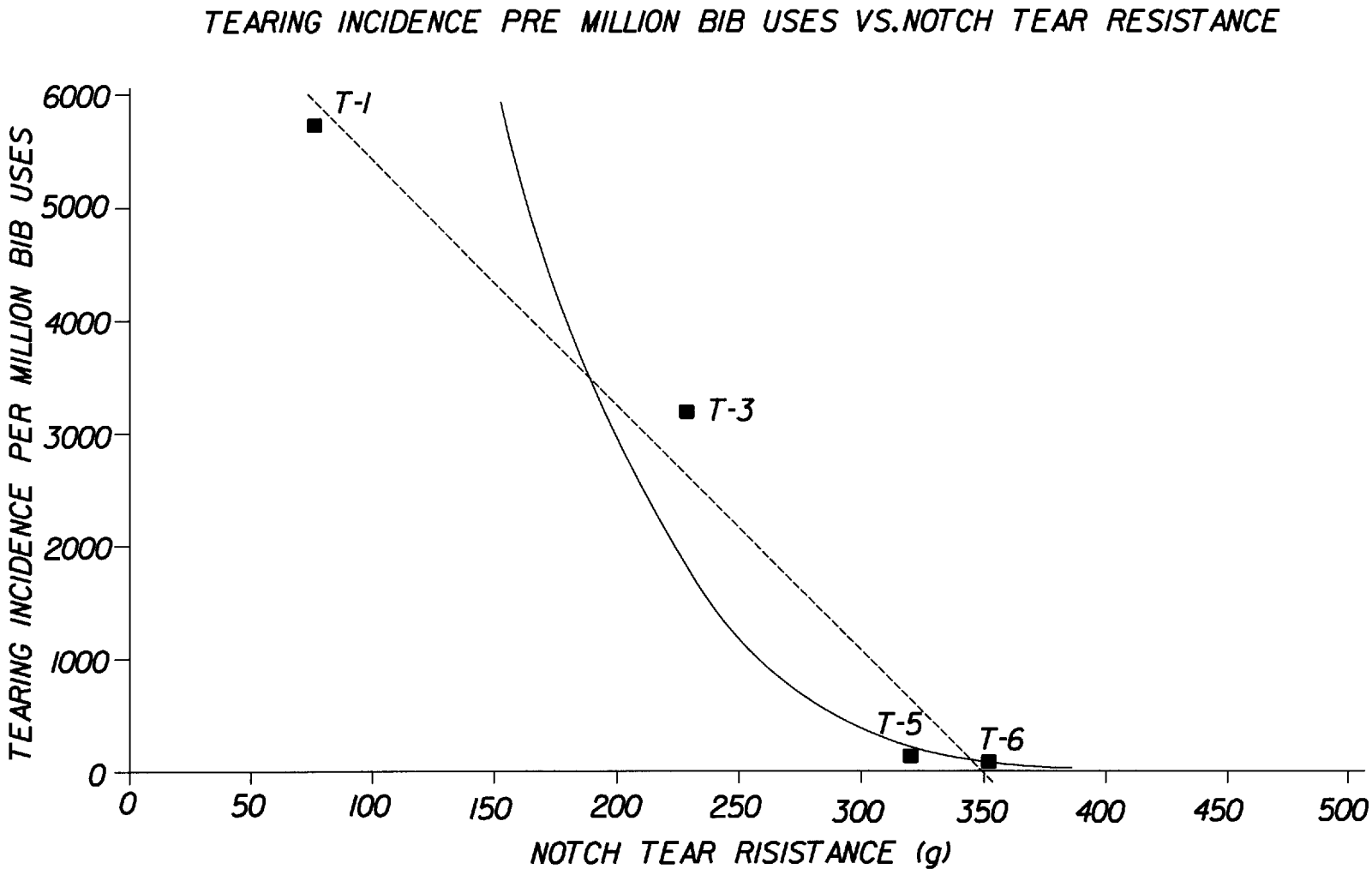
FIG. 6A is a graphical representation of bib tear incidence per million bib uses versus bib Notched Tear Resistance plotted for bib samples, the graph including a linear regression dotted line and a nonlinear regression curve of the plotted data.

Like FIG. 5, FIG. 6A is also a graphical representation of in use tearing incidence of bib test samples T1, T3, T5, and T6. The number of in use incidents of tearing (piece separated from bib) calculated for each test sample is plotted in units of incidents of tearing per million bib uses on the Y-axis. The in use tear incidence values in FIG. 6A were calculated from the same in home test participant data used to plot the Y axis values in FIG. 5. In FIG. 6A, however, the Notched Tear Resistance (NTR) for each test sample is plotted on the X axis. The values plotted in FIG. 6A are listed below in Table 2:

TABLE 2

NTR and Actual Tear Incidence per Million Bib Uses:

| Sample: | NTR (grams) | Tears per Million Uses |
|---|---|---|
| T1 | 76 sd 15 | 5848 |
| T3 | 230 sd 43 | 3252 |
| T5 | 323 sd 67 | 151 |
| T6 | 355 sd 35 | 94 |

FIG. 6A and Table 2 illustrate that the Notched Tear Resistance of the bib does correlate with the tear incidence of the bib. As the value of NTR increases, the number of tears per million uses decreases. In FIG. 6A, the dotted straight line represents a linear regression of the data points, and the solid curved line represents a nonlinear regression of the data points. The results shown in FIG. 6A illustrate the Applicants' discovery of what is believed to be a previously unrecognized correlation between a strength property of a bib and the actual in use incidence of tearing of the bib.

Figure 6B:
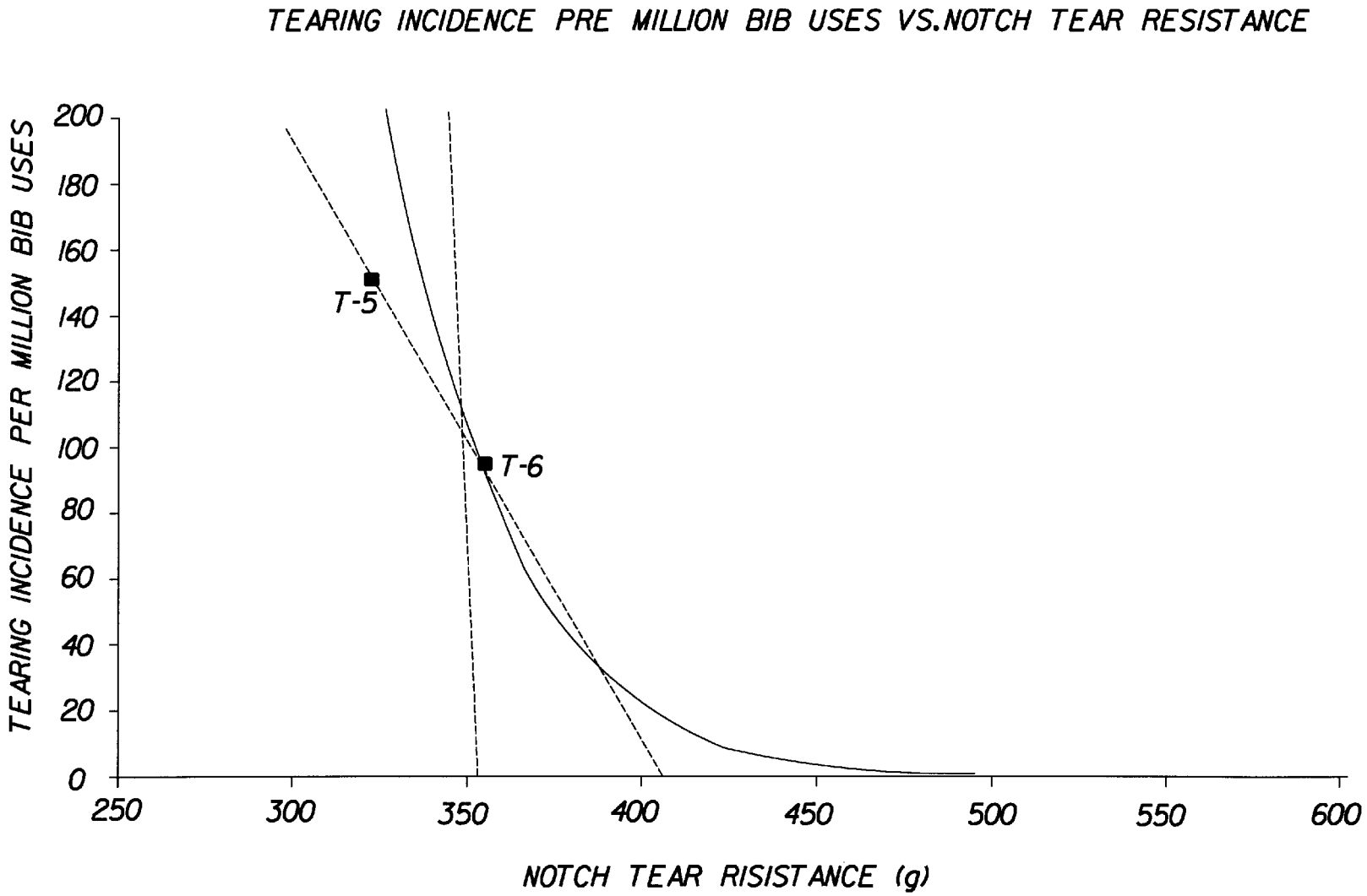
FIG. 6B is an enlarged illustration of a portion of the graphical representation of FIG. 6A showing a straight line drawn through two of the data points plotted in FIG. 6A to provide one approximation of the Notched Tear Resistance which provides less than about 1 tear incident per million bib uses.

FIG. 6B is shows a portion of FIG. 6A between 0 and 200 tear incidences per million uses. The straight line drawn through the two data points in FIG. 6B can be used to provide one estimate of the Notched Tear Resistance required to provide no more than about 1 tear in 1 million uses. The straight line in FIG. 6B predicts a Notch Resistance of at least about 410 grams will result in no more than about 1 tear in 1 million uses.

Figure 7:
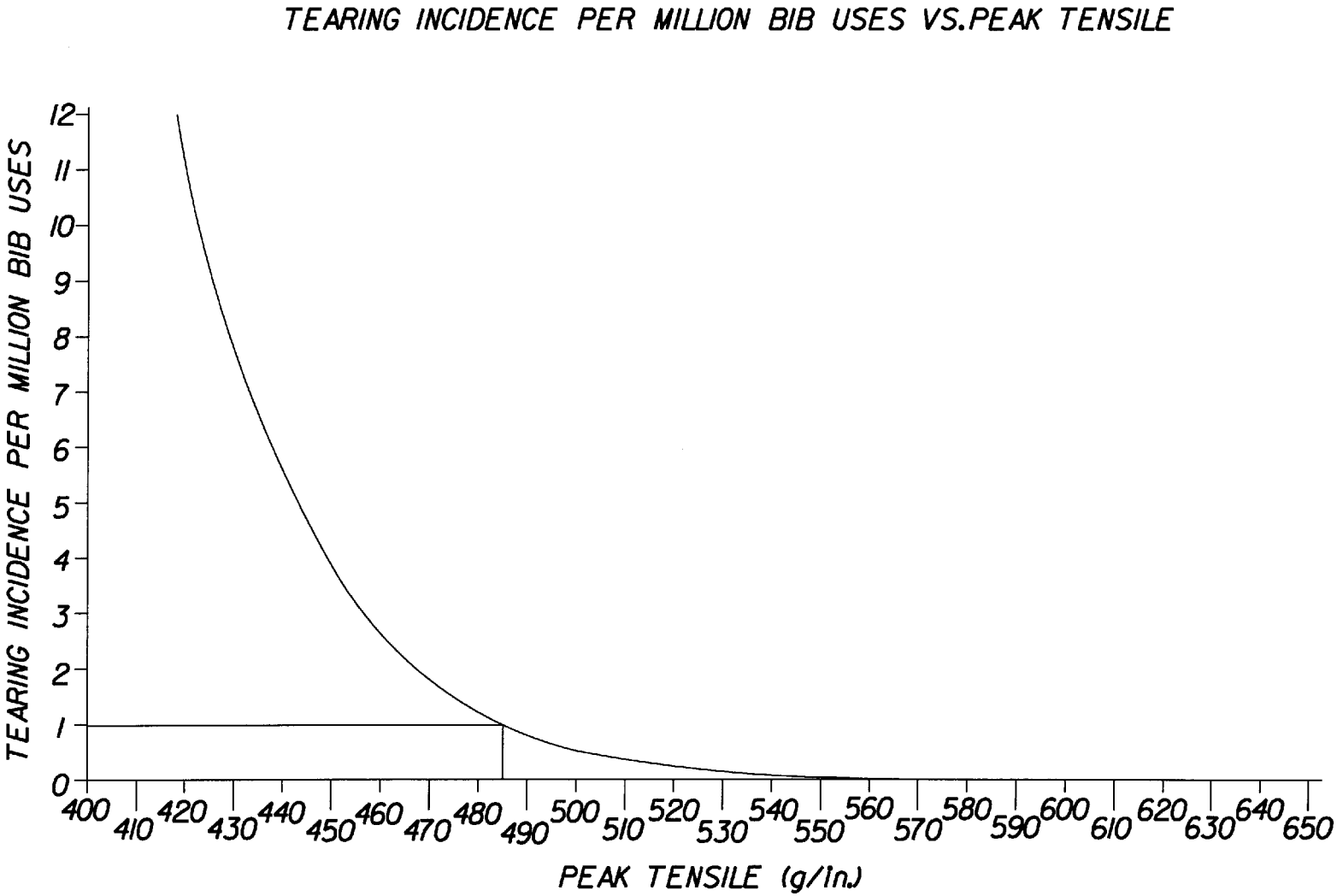
FIG. 7 is an enlarged illustration of a portion of the graphical representation of FIG. 6A showing the predicted Notched Tear Resistance required to achieve no more than about 1 tear incidence per million uses based upon the nonlinear regression curve in FIG. 6A.

FIG. 7 is a graph of Tearing Incidence versus Notched Tear Resistance derived from the graph of FIG. 6B. The solid curve in FIG. 7 is a continuation of the regression curve in FIG. 6B. The curve in FIG. 7 can be used to provide another, more conservative estimate of the Notched Tear Resistance required to provide no more than about 1 tear in 1 million uses. As indicated in FIG. 7, the curve provides an estimate of Notched Tear Resistance of about 485 grams needed to provide an in use tearing incidence of less than about 1 incident in about one million bib uses.

Table 3 below illustrates that embodiments X1, X2, N1, Z1, and Z2 provide a Notched Tear Resistance of greater than 500 grams, a level not previously achieved by samples T1–T6, nor by commercially available disposable bibs C1–C5.

Table 3 also illustrates that embodiments X1 and X2 of the present invention exhibit both an NTR greater than 500 grams, as well as a Circular Bend Stiffness (CBS) of less than 40 grams.

TABLE 3

| | Circular Bend Stiffness (grams) | | Notched Tear Resistance (grams) | |
|---|---|---|---|---|
| | Average | s.d. | Average | s.d. |
| T1 | 40.5 | 8.4 | 76 | 15 |
| T2 | 34.3 | 5.2 | 202 | 44 |
| T3 | 28.8 | 3.2 | 230 | 43 |
| T4 | 51.3 | 4.6 | 304 | 35 |
| T5 | 28.8 | 3.4 | 323 | 67 |
| T6 | 27.8 | 3.8 | 355 | 35 |
| X1 | 36.2 | 3.6 | 586 | 94 |
| X2 | 37.2 | 8.0 | 510 | 42 |
| N1 | 42.2 | 5.3 | 542 | 44 |
| Z1 | 46.6 | 6.3 | 628 | 36 |
| Z2 | 54.9 | 4.6 | 730 | 82 |
| C1 | 32.7 | 4.7 | 58 | 6 |
| C2 | 17.2 | 1.2 | 123 | 36 |
| C3 | 26.7 | 3.4 | 190 | 32 |
| C4 | 15.6 | 2.9 | 311 | 66 |
| C5 | 28.2 | 7.1 | 399 | 43 |

Circular Bend Stiffness, described below, provides a simultaneous measurement of bending stiffness in multiple directions, as opposed to other stiffness measurements that provide a bending stiffness value about a particular axis. Importantly, Applicants have also determined the important relationship of Circular Bending Stiffness of a bib to the consumer acceptance of the bib.

Figure 8:
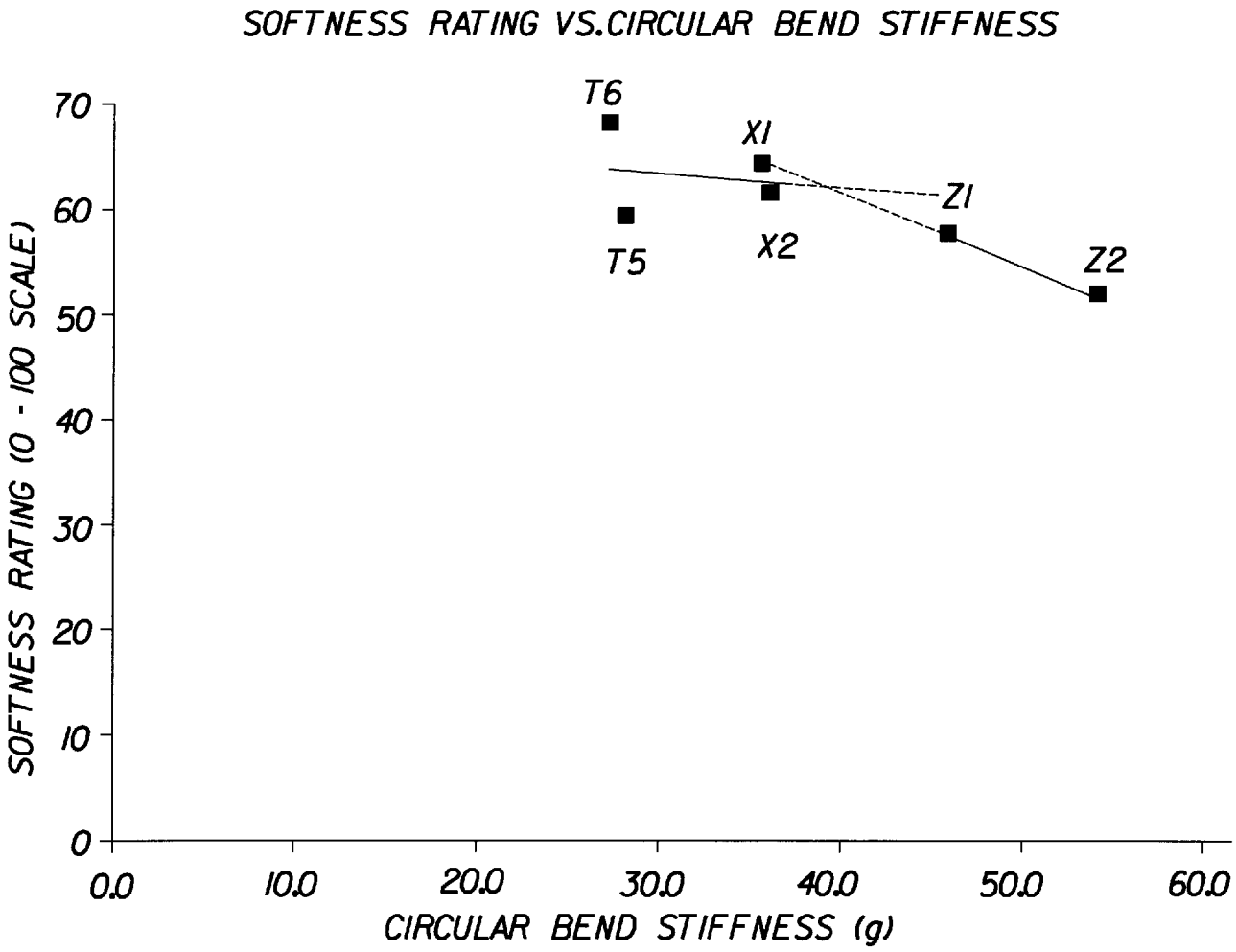
FIG. 8 is a graphical representation of consumer softness rating versus Circular Bending Stiffness data plotted for different bib samples.

FIG. 8 illustrates this relationship. In FIG. 8, the consumer softness rating of different bibs is plotted versus the Circular Bending Stiffness of the bibs. The consumer softness rating is a measure of the perceived softness rating that consumers attribute to a bib.

The consumer softness rating is obtained using the following procedure. Consumer test subjects who previously used one or more bibs per week were indentified. These test subjects were asked to use a blind labeled test product for a usage period of 3 days to 4 weeks in place of their regular bib. After the usage period, the test subjects were asked to give their overall rating of the softness of the blind labeled test bib as Excellent, Very Good, Good, Fair, or Poor. These ratings were assigned the following numerical values: Excellent=100; Very Good=75; Good=50; Fair=25; Poor=0. For each of the blind samples, the numerical values obtained were averaged to obtain the consumer softness rating plotted on the Y-Axis in FIG. 8 as Softness Rating Units (SRU).

The plotted values in FIG. 8 illustrate that bibs having a Circular Bending Stiffness of less than about 40 grams are perceived by consumers as being softer, and therefore more desirable, than are bibs having a higher Circular Bending Stiffness. As one would expect, an increase in stiffness leads to a loss of softness. Unexpectedly, however, Applicants have found that the loss of softness is generally insignificant up to a stiffness value of about 40–42 grams. The loss of softness is somewhat noticeable at a CBS value of between about 42 grams and about 50 grams. The loss of softness is even more noticeable above a CBS value of about 50–51 grams.

Table 4 below illustrates the change in softness which accompanies a change in Circular Bending Stiffness for the data plotted in FIG. 8. The values in Table 4 illustrate the different rate at which softness is lost as the value of CBS increases.

In Table 4, sample data is ordered and averaged within four stiffness intervals: 24–32; 33–41; 42–50; and 51–60. The change in softness rating and associated change in CBS value from interval to interval is indicated in Table 4.

TABLE 4

SOFTNESS RATING OVER A RANGE OF CIRCULAR BEND STIFFNESS

| Circular Bending Stiffness | | | | | |
|---|---|---|---|---|---|
| Experimental Range min./max. | 24 | 33 | 42 | 51 | 60 |
| Midrange Target (g.) | 28.5 | 37.5 | 46.5 | 55.5 | |
| Actual Sample Data | | | | | |
| Sample #1 (g.) | 27.8 (T6) | 36.2 (X1) | 46.6 (Z1) | 54.9 (Z2) | |
| Sample #2 (g.) | 28.8 (T5) | 37.2 (X2) | — | — | |
| Average (g.) | 28.3 | 36.7 | 46.6 | 54.9 | |
| Softness Rating (SRU) | | | | | |
| Sample #1 (SRU) | 69 (T6) | 65 (X1) | 58 (Z1) | 52 (Z2) | |
| Sample #2 (SRU) | 60 (T5) | 62 (X2) | — | — | |
| Average (SRU) | 64.5 | 63.5 | 58 | 52 | |
| Interval-to-Interval Change in absolute value | | | | | |
| CBS (g.) | base | +8.4 | +9.9 | +8.30 | |
| Softness (SRU) | base | −1.0 | −5.5 | −6.0 | |
| as a % (of preceding value) | | | | | |
| CBS (g.) | | +29.7% | +27.0% | +17.8% | |
| Softness (SRU) | | −1.6% | −8.7% | −10.3% | |

Table 5 below illustrates that for CBS values between 42 and 60, the loss of softness per unit increase in CBS is approximately 6.1 times greater than occurs for CBS values between about 24 and about 42.

TABLE 5

Comparison of Change in Softness to Increase in Stiffness

| | Lower Half of CBS Stiffness Range (24–42) | Higher Half of CBS Stiffness Range (42–60) |
|---|---|---|
| Change in Softness (SRU) | −1.0 (= 63.5 − 64.5) | −6.0 (= 52 − 58) |
| Change in CBS (g.) | +8.4 (= 36.7 − 28.3) | +8.3 (= 54.9 − 46.6) |
| ΔSRU/Δg. CBS | −.119 SRU/g. CBS | −.723 SRU/g. CBS |
| Comparison | Base = 1.0 | 6.1 × higher |
| Equation for Softness vs. Stiffness (over indicated half of stiffness range) | SRU = −.119 × CBS + 67.9 | SRU = −.723 × CBS + 91.7 |

The straight lines defined by the two equations in Table 5, above, are illustrated in FIG. 8. The difference in the slope of these two lines illustrates the increased loss in softness rating per unit increase in CBS above a CBS value of about 40 to about 42.

Accordingly, Tables 3, 4, and 5 illustrate the embodiments X1 and X2 provide a level of flexibility which is preferred by consumers, yet also provide a resistance to tearing sufficient to substantially reduce or eliminate in use tearing.

Table 6 provides values of Notched Tear Resistance, Circular Bend Stiffness, Peak Tensile Strength, Caliper, and Basis Weight for embodiments X1 and X2 as well as for commercially available samples C1–C5 and D1–D3.

TABLE 6

| | Circular Bend Stiffness (grams) | | Notched Tear Resistance (grams) | | MD Peak Tensile (grams/inch) | | Caliper (mils) | | Basis Weight (mg/cm$^2$) |
|---|---|---|---|---|---|---|---|---|---|
| | Average | s.d. | Average | s.d. | Average | s.d. | Average | s.d. | Average |
| X1 | 36.2 | 3.6 | 586 | 94 | 4401 | 778 | 24 | 1 | 8.5 |
| X2 | 37.2 | 8.0 | 510 | 42 | 4711 | 419 | 30 | 1 | 10.0 |
| C1 | 32.7 | 4.7 | 58 | 6 | 2094 | 56 | 12 | 1 | 8.0 |
| C2 | 17.2 | 1.2 | 123 | 36 | 2601 | 181 | 14 | 1 | 8.0 |
| C3 | 26.7 | 3.4 | 190 | 32 | 1250 | 67 | 14 | 0 | 6.7 |
| C4 | 15.6 | 2.9 | 311 | 66 | 4050 | 48 | 18 | 1 | 11.1 |
| C5 | 28.2 | 7.1 | 399 | 43 | 4198 | 209 | 12 | 0 | 8.3 |
| D1 | 48.2 | 7.5 | >1600* | * | 16054 | 1570 | 147 | 7 | 46.2 |
| D2 | 58.5 | 10.2 | >1600* | * | 12540 | 508 | 37 | 2 | 33.5 |
| D3 | 57.5 | 6.1 | 1234 | 164 | 9050 | 188 | 6 | 0 | 17.1 |

*exceeded 1600 g capacity of equipment

The data in Table 6 illustrate that the embodiments X1 and X2 provide a NTR of greater than 500 grams, a CBS of less than 40 grams, and yet have a Peak Tensile Strength of less than 5000 grams/inch. In contrast, commercially available disposable bibs C1–C5 do not provide the Notched Tear Resistance of at least about 410 grams. Commercially available bibs D1–D3 have NTR values exceeding 500 grams, but use woven components, and have a basis weight in excess of 15 milligrams/square centimeter. In addition, D1–D3 have CBS values in excess of 40 grams.

Figure 9:
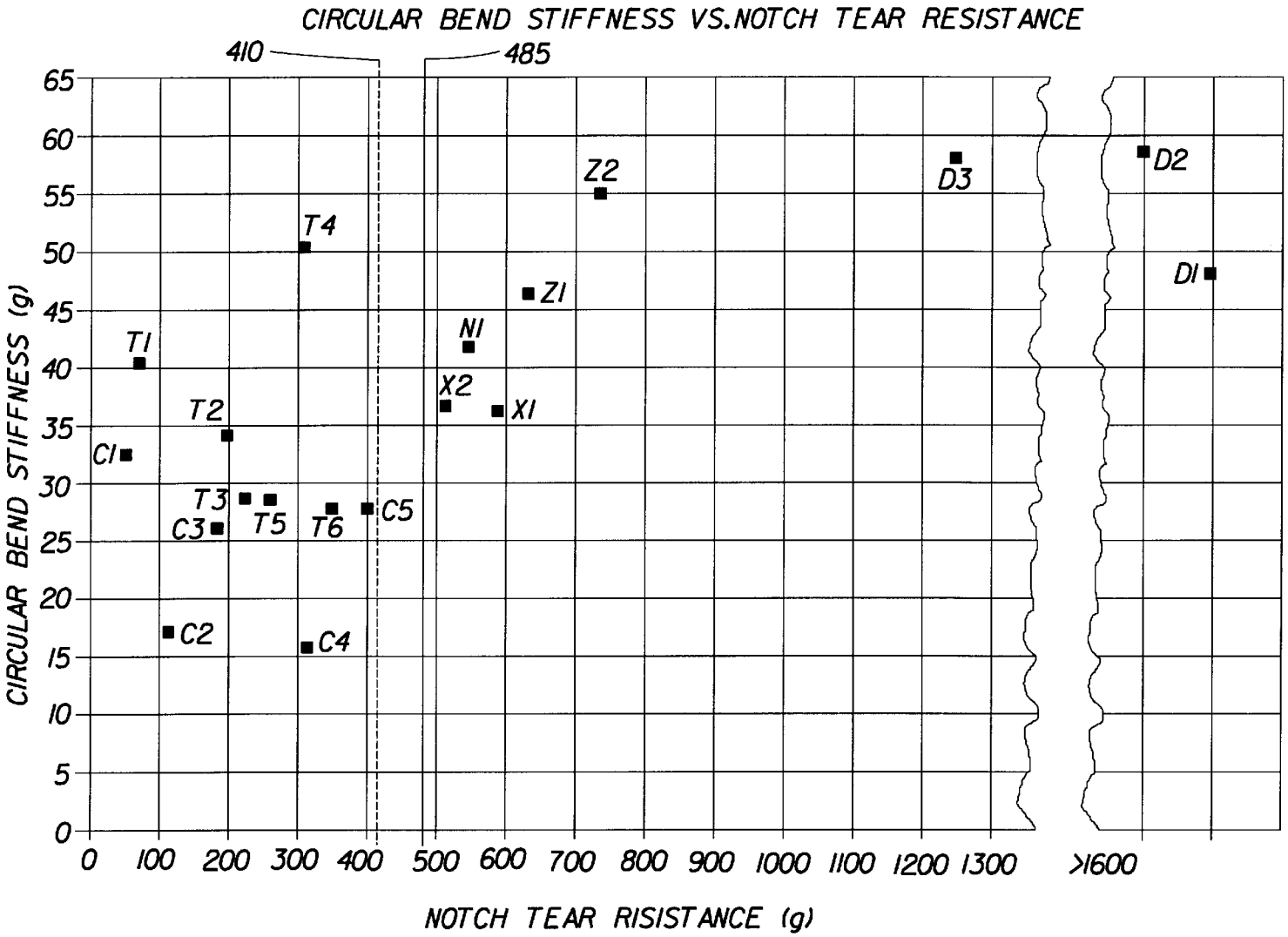
FIG. 9 is graphical representation of Circular Bending Stiffness versus Notched Tear Resistance plotted for different bib samples.

FIG. 9 is a graph of Circular Bend Stiffness in units of grams along the Y axis versus Notched Tear Resistance in units of grams along the X axis. In FIG. 9, the data for samples D1 and D2 are plotted for the sake of illustrating the samples' CBS values. The NTR values for the samples D1 and D2 could not be measured because they exceed the capability of the device used to measure tear resistance.

FIG. 9 illustrates that embodiments X1, X2, N1, Z1, and Z2 provide a Notched Tear Resistance of greater than 500 grams. FIG. 9 also illustrates that embodiments X1 and X2 of the present invention exhibit both a Notched Tear Resistance in excess of 500 grams, as well as a Circular Bending Stiffness of less than 40 grams. Accordingly, the embodiments of X1 and X2 provide a level of flexibility which is preferred by consumers, yet also provide a resistance to tearing sufficient to substantially reduce or eliminate in use tearing.

DESCRIPTION OF EMBODIMENTS

Embodiment X1

Referring to the components of the bib 20 shown in FIGS. 1–4, the embodiment of the present invention designated X1 comprises a laminate of an absorbent outer topsheet layer 40 for receiving spilled food material and a liquid impermeable backsheet 80.

The topsheet 40 comprises outer ply 40A and inner ply 40B. The outer ply 40A and the inner ply 40B each comprise a paper web having a basis weight of about 21.2 gram/square meter (13 lb per 3000 square feet). Each ply is made according to Example 1 of U.S. Pat. No. 5,223,096 issued Jun. 29, 1993 to Phan et al., which patent is incorporated herein by reference.

The two plies of paper 40A and 40B are combined by nested embossing and laminating the plies together, such as is taught generally in U.S. Pat. No. 3,414,459 issued to Wells on Dec. 3, 1968, which patent is incorporated herein by reference. The two plies are first separately carried through separate embossing nips. Each embossing nip is formed by a rubber anvil roll and a steel pattern roll.

The rubber anvil roll has a diameter of about 14 inches and a P&J hardness of about 100 measured with a ⅛ inch ball. The steel pattern roll has a diameter of about 18 inches. The nip loading is about 100 pounds per lineal inch. The steel pattern roll has, on average, about 36 protuberances per square inch arranged in diamond shaped patterns. Each protuberance has a generally elliptically shaped end having a major axis of about 0.084 inches, a minor axis of about 0.042 inches and extending radially outwardly from the periphery of the anvil roll about 0.070 inches. The ends of the protuberances (having an area of about 0.003 square inches) provide a land area of about 11 percent of the roll surface area. The diamond pattern repeat distance is about 1.66 inches (center of diamond to center of next diamond in machine direction or cross-machine direction).

Ply bonding adhesive is applied to one of the plies after the plies pass through the embossing nips. The two plies are then carried together through a marrying nip formed between a marrying roll having a diameter of about 14 inches and one of the two steel pattern rolls. The marrying roll has a hard rubber cover with a P&J hardness of 12 using a ⅛ inch ball. The marrying nip loading is about 100 pounds per lineal inch.

The plybond adhesive used to join the plies 40A and 40B is an aqueous solution containing 7.2 percent by weight fully hydrolyzed polyvinyl alcohol (Dupont Evanol 71-30 brand), 1.8 percent by weight water soluble polyamide-epichlorohydrin polymer (Hercules Kymene 557H brand). The plybond adhesive is applied to the embossments of one of the plies in a sufficient quantity to provide the two ply paper topsheet with about 24 grams of total solids per 3000 square feet.

The backsheet 80 comprises a low density polyethylene film manufactured by Tredegar Film Products of Terre Haute, Ind. as CPC-2 film Model X10392 and having a nominal thickness by weight of about 2.0 mils (0.002 inch).

The backsheet 80 is joined to the ply 40B with a commercially available HL1262 adhesive from the H. B. Fuller Company of St. Paul, Minn. About 4 to 5 milligrams of the adhesive are applied per square inch of backsheet 80 using a meltblown application process.

Some properties of the materials in the laminate, including the backsheet film and the topsheet paper plies, can have a machine directionality. The film and the topsheet plies are joined together such that the machine directions of the film and the paper plies are generally perpendicular to the axis 21 of the bib.

Embodiment X2

Embodiment X2 of the present invention is made according to the description for embodiment X1, with the following changes. The backsheet 80 for embodiment X2 is a low density polyethylene film manufactured by Tredegar as CPC-2 film Model X10348 having a nominal thickness by weight of about 2.0 mils (0.002 inch).

The backsheet 80 is joined to the ply 40B with a Fuller H2031 adhesive. The H2031 adhesive is applied in an overlapping spiral pattern to the backsheet 80. About 5 to 6 milligrams of the adhesive are applied per square inch of backsheet 80.

Embodiment N1

Embodiment N1 comprises a laminate of a non-woven web, two paper plies, and a thermoplastic backsheet. The non-woven web faces outwardly, the backsheet faces the body of the wearer, and the two paper plies are disposed between the non-woven web and the backsheet. Embodiment N1 has plies 40A and 40B made as described above for embodiments X1 and X2 except that the ply bond adhesive used to join the plies together is a polyvinyl alcohol plybond adhesive in an aqueous solution containing 4.0 percent by weight fully hydrolyzed polyvinyl alcohol (Dupont Evanol 71-30 brand) which does not contain a water soluble polyamide-epichlorohydrin polymer and has a non-woven joined to ply 40A. The backsheet 80 is a Tredegar film Model X9991 having a nominal thickness by weight of about 1.1 mils. The backsheet 80 is joined to the ply 40B with about 5–6 milligrams per square inch of Findley H2031 adhesive applied in an overlapping spiral pattern. A carded polypropylene non-woven web is joined to the ply 40A with about 5–6 milligrams per square inch of Findley H2031 adhesive applied in an overlapping spiral pattern. The non-woven has a basis weight of about 22 grams per square meter and is commercially manufactured by the Veratec Division of the International Paper Corporation of Walpole, Mass. under the designation P-11, Supplier Grade #9324369.

Embodiments Z1 AND Z2

Embodiments Z1 and Z2 have plies 40A and 40B made as described above for embodiments X1 and X2. The backsheet 80 of Z1 is a Tredegar film Model X10349 having a nominal thickness by weight of about 2.5 mils. The backsheet 80 is joined to the ply 40B with about 5–6 milligrams per square inch of Findley H2031 adhesive applied in an overlapping spiral pattern. The backsheet 80 of embodiment Z2 is a Tredegar film Model X10350 having a nominal thickness by weight of about 3.0 mils. The backsheet 80 is joined to the ply 40B with about 5–6 milligrams per square inch of Findley H2031 adhesive applied in an overlapping spiral pattern.

Sample T1

Sample T1 has plies 40A and 40B made as described above for embodiments X1 and X2. The backsheet 80 of T1 is a Clopay film Model 3051 manufactured by Clopay Plastic Products Company of Cincinnati, Ohio and having a nominal thickness by weight of about 1.2 mils. The backsheet 80 is joined to the ply 40B with about 5–6 milligrams per square inch of Findley H2031 adhesive applied in an overlapping spiral pattern.

Sample T2

Sample T2 has plies 40A and 40B made as described above for embodiments X1 and X2. The backsheet 80 of T2 is a Tredegar film Model X10351 having a nominal thickness by weight of about 2.0 mils. The backsheet 80 is joined to the ply 40B with about 5–6 milligrams per square inch of Findley H2031 adhesive applied in an overlapping spiral pattern.

Sample T3

Sample T3 has plies 40A and 40B made as described above for embodiments X1 and X2, except that the ply bond adhesive used to join the plies together is a polyvinyl alcohol plybond adhesive which does not contain a water soluble polyamide-epichlorohydrin polymer. The backsheet 80 of T3 is a Tredegar film Model X9781 having a nominal thickness by weight of about 1.2 mils. The backsheet 80 is joined to the ply 40B with about 5–6 milligrams per square inch of Findley H2031 adhesive applied in an overlapping spiral pattern.

Sample T4

Sample T4 has plies 40A and 40B made as described above for embodiments X1 and X2. The backsheet 80 of T4 is a Tredegar film Model X10352 having a nominal thickness by weight of about 3.0 mils. The backsheet 80 is joined to the ply 40B with about 5–6 milligrams per square inch of Findley H2031 adhesive applied in an overlapping spiral pattern.

Sample T5

Sample T5 has plies 40A and 40B made as described above for embodiments X1 and X2. The backsheet 80 of T5 is a Tredegar film Model X9991 having a nominal thickness by weight of about 1.1 mils. The backsheet 80 is joined to the ply 40B with about 5–6 milligrams per square inch of Findley H2031 adhesive applied in an overlapping spiral pattern.

Sample T6

Sample T6 has plies 40A and 40B made as described above for embodiments X1 and X2. The backsheet 80 of T6 is a Clopay film Model 1401 having a nominal thickness by weight of about 1.5 mils. The backsheet 80 is joined to the ply 40B with about 4–5 milligrams per square inch of Findley H2120 adhesive applied using a gravure process.

Commercial Samples C1–C5

Samples C1–C5 are commercially available bibs.

C1 is a BARNEY brand disposable bib manufactured by Playskool Baby, Inc., of Northvale, N.J., and having a non-woven front and a film backing.

C2 is a BIBBIES brand disposable bib manufactured by EL-LO Manufacturing Co., of West Bloomfield, Mich., and having a non-woven front and a film backing.

C3 is a TOMMIE TIPPIE brand disposable bib manufactured by Jackel International Ltd., of Northumberland UK, and having a non-woven front and a film backing.

C4 is a LAMMIES brand disposable bib manufactured by Lam Industries of Culver City, Colo., and having a non-woven front and a film backING. The product label states the Lammies bib has Dupont Dacron polyester.

C5 is a CRUMPLES brand disposable bib manufactured by Crumples Products, Inc. of Birmingham, Mich., and having a non-woven front and a film backing. The product label states that the bib has a non-woven made with natural fibers.

Commercial Samples D1–D3

Samples D1–D3 are commercially available bibs having at least one woven component. D1 is a cloth bib having a woven terrycloth body surrounded by a woven border stitched to the body. D2 is a PLAYSKOOL brand bib manufactured by Playskook Baby, Inc., of Northvale, N.J., and having woven cloth front, a plastic-like back, and a woven border stitched to the body of the bib. The product label states that the D2 bib is 100 percent cotton terry, with waterproof vinyl plastic, and washable. Sample D3 is a PLAYSKOOL brand bib having a plastic like sheet body surrounded by a woven border which is stitched to the body.

TEST METHODS

Notched Tear Resistance (NTR):

The Notched Tear Resistance is a measure of the propagation tear resistance of thin substrates as generally set forth in ASTM D 1922-89: "Standard Test Method for Propagation Tear Resistance of Plastic Film and Thin Sheeting by Pendulum Method", which ASTM standard Test Method is incorporated herein by reference. Any variations from ASTM D 1922-89 are set forth below.

The Notched Tear Resistance is a measure of the force in grams required to propagate tearing across a specimen using a pendulum device. The pendulum swings through an arc, tearing the specimen along a precut slit. The specimen is held on one side by the pendulum and on the side by a stationary member. The loss in energy by the pendulum is indicated on a digital readout. The digital readout varies from 0–100, and is based on a sensor which measures the travel of the pendulum after tearing the specimen. The readout is a function of the force required to tear the specimen. Alternatively, a calibrated mechanical pointer can be used to provide the value between 0–100. The pendulum device is an Elmendorf Tearing Tester, Model 60-16 having a 1600 gram force capacity, and manufactured by the Thwing Albert Instrument Co. of Philadelphia, Pa.

Prior to measuring the NTR, the bib samples are conditioned at standard conditions (about 73 degrees Fahrenheit and about 50 percent relative humidity for at least about 2 hours. For each bib sample, at least two specimens are cut from the bib body. Two tear measurements are made from each specimen, for a total of at least 4 tear measurements. The measurements are made (i.e. the specimen is torn) in the direction that yields the lowest value of NTR. Preliminary measurements can be made to determine the direction of lowest tear resistance. For embodiments X1 and X2, the tear resistance is measured perpendicular to the axis 21 of the bib.

The specimens are cut 3 inches long by 2.5 inches wide. The specimen is placed in the clamps of the pendulum tester (one clamp is stationary, the other is supported on the pendulum arm). The specimen is placed in the clamps such that topsheet or front faces in the direction of travel of the pendulum arm.

The specimen is precut to form a notch 20 mm long parallel to the 2.5 inch dimension of the specimen about ⅓ of the way along the 3.0 inch dimension. The pendulum arm is then released, tearing the sample. The digital readout is recorded and multiplied by 16 to obtain the tearing force in grams-force according to ASTM D 1922-89. The remaining portion of the specimen is then reclamped and precut to form a notch 20 mm long at the midpoint of the remaining specimen. The pendulum arm is released, and the second measurement of tearing force is obtained. At least four measurements (2 measurements from at least two bib specimens) are measured and averaged to obtain the NTR of the particular bib sample.

Circular Bend Stiffness Test (CBS):

The Circular Bend Stiffness is a multi-directional measurement of the stiffness of a test specimen which is performed by simultaneous multi-directional deformation of a specimen. The procedure for measuring the Circular Bend Stiffness of a specimen is described generally in columns 10–12 of U.S. Pat. No. 5,009,653 issued Apr. 23, 1991 in the name of Osborn, which patent is incorporated herein by reference. The procedure set forth in the U.S. Pat. No. 5,009,653 patent is used to measure CBS of a specimen, with any variations from the U.S. Pat. No. 5,009,653 patent being listed below.

The test apparatus includes a smooth polished steel plate having an orifice, a plunger, and a ball nose, each having the dimensions as specified in the U.S. Pat. No. 5,009,653 patent. The ball nose does not include a needle point. The apparatus also includes an actuator and load cell having a load range of 0 to 4000 grams. Specifically, an EME Tensile Tester, Model #599A manufactured by EME, Inc. of Newbury, Ohio is used.

The test plate is leveled and the plunger speed is set at 50 centimeters per minute per full stroke length. A specimen measuring 1.5 inch by 1.5 inch is cut from the same general portion of the bib body from which the specimens for the NTR test are taken. The specimen is centered on the orifice below the plunger. (Specimens are conditioned prior to testing as described in U.S. Pat. No. 5,009,653). The plunger is actuated, and the downward stroke of the ball nose is to the exact bottom of the plate orifice. The maximum force reading as the ball nose deflects the specimen into the orifice is recorded to the nearest gram.

For a particular bib sample, eight specimens measuring 1.5 inch by 1.5 inch are cut from the bib body. Four of the specimens are measured with one side of the specimen (e.g. the topsheet 40) facing upward, and four specimens are measured with the other side (e.g. the backsheet 80) facing upward. The eight values are averaged to obtain the CBS value for the sample.

Peak Tensile Strength:

The peak tensile strength of a bib sample is measured with reference to the INDA standard test IST 110.1-92 of the Association of the Non-woven Fabrics Industry, which standard is incorporated herein by reference. Bib test specimens are cut from the same general portion of the bib body from which the specimens for the NTR test are taken. The specimens are cut to have a width of 1.0 inch and a length great enough to provide a 2.0 inch gauge length. The specimens are pulled in a tensile testing machine parallel to the direction in which the specimens are torn in the NTR test (e.g. specimen length is oriented perpendicular to the axis 21 for embodiments X1 and X2). Prior to measuring the Peak Tensile Strength, the bib samples are conditioned at standard conditions (about 73 degrees Fahrenheit and about 50 percent relative humidity for at least about 2 hours).

The samples are placed squarely in the jaws of an Instron Model 5564 constant rate of elongation tensile testing machine. One inch, line-contact grips are used to avoid any sample slippage. The samples are pretensioned to zero load at a 2.0 inch gauge length. Force is measured with a 100 Newton load cell and recorded continuously as the sample is elongated at a crosshead speed of 20 inches per minute to complete failure. In all cases a local maxima occurs in the first inch of elongation. This initial peak force, in grams, is recorded for each specimen. At least four specimens are measured and averaged to provide the Peak Tensile Strength, in grams per 1 inch specimen width, for the sample.

Caliper Measurement:

The caliper (thickness) of a bib sample is measured in the same general portion of the bib from which the NTR specimens are made. The caliper is measured by confining the bib between a flat surface and a circular load foot, the circular load foot having a diameter of 0.95 inch and providing a confining pressure of 0.10 psi. A suitable device for measuring the caliper of a bib is an Ono Sokki GS503 Linear Gauge Sensor and an Ono Sokki DG3610 Digital Gauge made by Ono Sokki of Japan. The caliper is an average of at least 4 measurements.

Basis Weight:

The basis weight is the weight per unit area of the bib measured in the same general portion of the bib from which the NTR measurements are made.

While particular embodiments of the present invention have been illustrated and described, it would be obvious to those skilled in the art that various other changes and modifications can be made without departing from the spirit and scope of the invention.

What is claimed:

1. A disposable bib comprising a laminate of an absorbent outer topsheet layer and a liquid impermeable backsheet layer wherein said topsheet layer further comprises an outer ply and an inner ply embossed and laminated together with discrete bond sites, said bib having a Notched Tear Resistance (NTR) of at least about 410 grams and a Circular Bend Stiffness (CBS) of less than about 60 grams.

2. The disposable bib of claim 1 wherein the bib has an NTR of at least about 485 grams.

3. The disposable bib of claim 1 wherein the bib has a CBS of less than about 50 grams.

4. The disposable bib of claim 3 wherein the bib has a CBS of less than about 40 grams.

5. The disposable bib of claim 1 wherein the bib has a Peak Tensile Strength of less than about 8000 grams/inch.

6. The disposable bib of claim 5 wherein the bib has a Peak Tensile Strength of less than about 6000 grams/inch.

7. The bib of claim 1 wherein the bib comprises one or more layers selected from the group consisting of paper webs, non-wovens, and combinations thereof.

8. The bib of claim 7 wherein the bib further comprises a thermoplastic film backsheet.

9. The bib of claim 1 wherein the bib has no woven components.

10. A disposable bib comprising a laminate of an absorbent outer topsheet layer and a liquid impermeable backsheet layer wherein said topsheet layer further comprises an outer ply and an inner ply embossed and laminated together with discrete bond sites, said bib having a Notched Tear Resistance (NTR) of at least about 410 grams and a Peak Tensile Strength of less than about 8000 grams/inch.

11. The disposable bib of claim 10 wherein the bib has a Peak Tensile Strength of less than about 6000 grams/inch.

12. The disposable bib of claim 10 wherein the bib has an NTR of at least about 485 grams.

13. The disposable bib of claim 10 wherein the bib has an NTR of at least about 500 grams.

14. The disposable bib of claim 13 wherein the bib has a Circular Bend Stiffness (CBS) of less than about 60 grams.

15. The disposable bib of claim 14 wherein the bib has a CBS of less than about 50 grams.

16. The disposable bib of claim 15 wherein the bib has a CBS of less than about 40 grams.

17. The bib of claim 11 wherein the bib comprises one or more layers selected from the group consisting of paper webs, non-wovens, and combinations thereof.

18. The bib of claim 17 wherein the bib further comprises a thermoplastic film backsheet.

19. A disposable bib comprising:

a laminate of an outwardly facing absorbent topsheet layer and a body facing liquid impermeable backsheet layer, said topsheet layer further comprising an outer ply and an inner ply embossed and laminated together with discrete bond sites; wherein at least one of the plies is selected from the group consisting of paper webs, non-wovens, and combinations thereof; and wherein the bib has a Notched Tear Resistance (NTR) of at least about 485 grams and a Circular Bending Stiffness (CBS) of less than about 40 grams.

20. The bib of claim 19, further comprising a longitudinal axis wherein the topsheet layer and the backsheet layer are joined together such that the machine directions of the topsheet layer and the backsheet layer are perpendicular to the longitudinal axis.

* * * * *